United States Patent [19]

Cross

[11] 4,056,464

[45] Nov. 1, 1977

[54] MINERAL JIGS

[76] Inventor: Donald James Cross, 3 Grange Road, Bearsden, Glasgow G61 3PL, Scotland

[21] Appl. No.: 686,897

[22] Filed: May 17, 1976

[30] Foreign Application Priority Data

May 23, 1975 United Kingdom ..... 22505/75

[51] Int. Cl.[2] ..... B03B 5/16

[52] U.S. Cl. ..... 209/425; 209/44; 209/486

[58] Field of Search ..... 209/425–427, 209/444, 450, 446, 44, 455–457, 486, 500, 18, 144, 211

[56] References Cited

U.S. PATENT DOCUMENTS

| | | | |
|---|---|---|---|
| 300,947 | 6/1884 | Carkeek | 209/444 |
| 1,629,182 | 5/1927 | Stull | 209/211 |
| 3,273,714 | 9/1966 | Cleaveland | 209/456 |
| 3,372,805 | 3/1968 | Lykken et al. | 209/144 |
| 3,703,237 | 11/1972 | Cohen-Alldro et al. | 209/426 |
| 3,844,414 | 10/1974 | Jordison | 209/144 X |
| 3,902,601 | 9/1975 | Townley | 209/144 |

*Primary Examiner*—Frank W. Lutter
*Assistant Examiner*—Ralph J. Hill
*Attorney, Agent, or Firm*—Mason, Fenwick & Lawrence

[57] ABSTRACT

A mineral jig for use in treatment plants for the concentration of heavy minerals e.g. cassiterite, gold, platinum, garnet, pyrites and magnetite includes a container for water comprising an upper substantially cylindrical portion and a lower frusto-conical plunger portion, the container including an inlet for water and an outlet for concentrated slurry. A rotor of dished or inverted frusto-conical form is mounted for rotation in the upper portion, and carries a screen of wire mesh or perforated metal. A drive is provided for vertical oscillation of the plunger and a water seal is located between the portions. In operation, slurry on the rotor is subjected to pulsations as a result of the plunger oscillations and to centrifugal force causing a vortex to form in the container co-axial therewith. Heavy mineral passes through the screen and is concentrated prior to collection, while lighter metals move up the rotor and eventually spill over the edge thereof for subsequent collection.

14 Claims, 8 Drawing Figures

MINERAL JIGS

The present invention concerns mineral jigs.

Mineral jigs are used in treatment plants for the concentration of heavy minerals, e.g. cassiterite, gold, platinum, garnet, pyrites and magnetite. A conventional multi-cell jig is fed with a slurry which contains, for example, 0.5 lbs. per heavy mineral per cubic yard and by virtue of its design discharges an underflow or concentrate of the order of 4 to 5 lbs. per cubic yard. In the past the process has been arranged in two or more stages which can result in concentrates of upwards of 15 lbs. per cubic yard.

The most popular mineral jig in use today, particularly in the alluvial mineral industry, is known as a Yuba jig and is described in U.K. Pat. No. 612874.

The process of the concentration of heavy mineral by jigging has been described as being achieved by a combination of elutriation and hindered settling (Stokes' Law) and certain dynamic phenomena imparted by a pulsating action. In the past this pulsating action has usually been derived from an eccentric driving arrangement which gives rise to a sinusoidal movement. Past jigs have been gravity separating machines and as a result the upward and downward pulses are equal and opposite.

Fairly recently it has been discovered that by altering the waveform of the pulses, increasing the downwards acceleration, an improved performance was obtainable.

It is an object of the present invention to obviate or mitigate the disadvantages of prior jigs.

According to the present invention there is provided a mineral jig including a container for water, means associated with the container for causing said water to pulsate, an inlet to the container for water and an outlet from the container for concentrated slurry and a dished rotor mounted for rotation in the container about a substantially vertical axis to cause a vortex to form therein, said rotor including screen means adapted to receive the material to be treated.

Preferably the rotor has an inverted substantially frusto-conical form.

Preferably the container has a top portion including a cylindrical portion and a bottom inverted frusto-conical portion.

Preferably the bottom portion is provided with means to cause oscillation thereof in a vertical direction to generate said pulsations in the water.

Preferably a diaphragm of a resilient material is provided between the top and bottom portions of the container.

The base of the top portion of the container may taper inwardly.

Preferably said outlet from the container is provided at the bottom of said inverted frusto-conical portion.

Preferably the outlet includes a replaceable outlet nozzle of a resilient abrasion resistant material.

Preferably said rotor comprises a bed frame on which said screen means is supported.

The screen means may be woven wire mesh or perforated sheet metal.

Preferably the container has a radially inwardly extending flange at its top end and the rotor has a radially outwardly extending lip, a labyrinth seal being positioned between said lip and said flange.

Preferably the top end of the cylindrical portion of the container is provided with a volute shaped discharge trough in which tailings spilling over the lip of the rotor are collected.

Further according to the present invention there is provided a method of separating minerals from a mixture of said minerals and relatively lighter minerals, comprising mixing said mixture with water, imparting pulsations to said water and mixture and subjecting said mixture to centrifugal force such that said lighter minerals are separated from said minerals by a combination of elutriation and hindered settling.

Preferably said mixture is subjected to centrifugal force by forming a vortex in said water.

An embodiment of the present invention will now be described by way of example with reference to the accompanying drawings in which.

Figure 1:
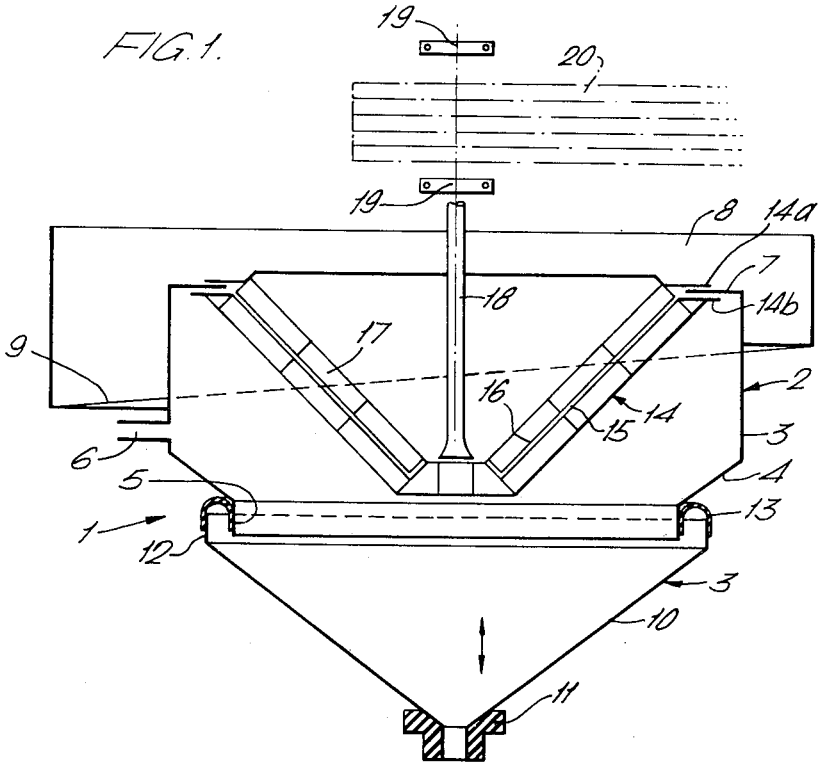
FIG. 1 shows a schematic front view of a mineral jig according to the present invention, in cross-section.
Figure 2:
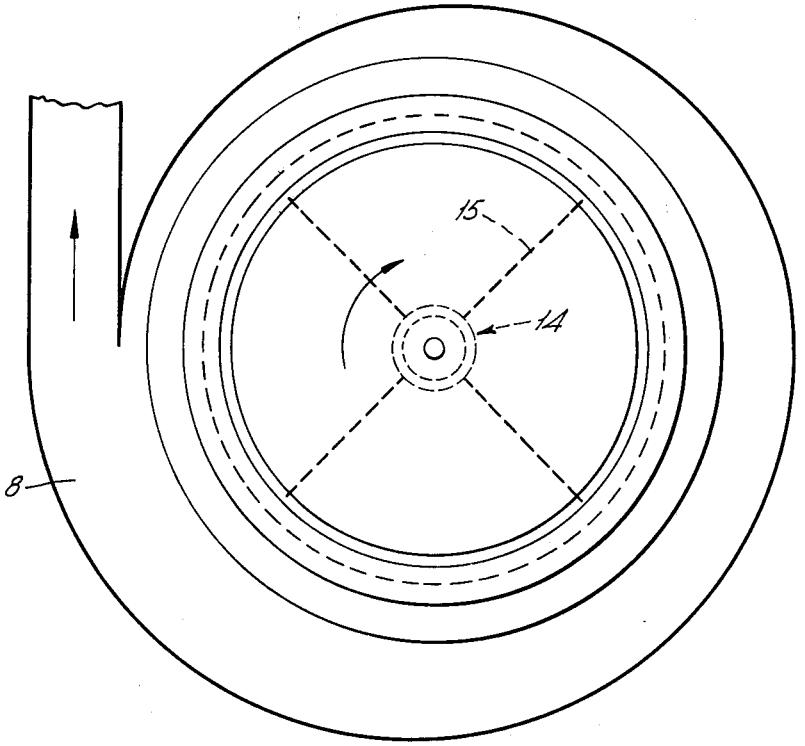
FIG. 2 shows a plan view of the jig of FIG. 1.

Referring to FIGS. 1 and 2, a mineral jig 1 comprises a container for water including a top portion 2 and a bottom portion or plunger 3. The top portion 2 comprises a cylinder 3 merging with an inverted conical frustum 4, the lower end of the frustum 4 having a vertically downwardly directed spigot 5. The top portion 2 is provided with a water inlet 6 and the upper end of the cylindrical part 3 has a radially inwardly directed flange 7.

A volute-shaped discharge trough 8 having an inclined base 9 is provided around the top of the cylinder 3.

The plunger portion 3 of the container comprises an inverted conical frustum 10 having a moulded abrasion resistant rubber outlet nozzle 11 at its base and a vertically upwardly directed socket 12 at its top, the radius of said socket 12 being greater than the radius of the spigot 5 of the top portion 2, such that the top portion spigot 5 telescopes within the plunger socket 12. A rubber diaphragm 13 of inverted U-cross-section sealingly engages the spigot 5 and socket 12 of the top and bottom portions 2, 3 to provide a watertight seal between the portions which permits vertical oscillation of the bottom plunger 3 relative to the top portion 2.

A rotor 14 is provided in the cylinder 3 and comprises a bed frame 15 on which a woven mesh screen 16 is supported and a basket arrangement 17 being supported in turn on the screen 16.

The rotor 14 is dished and takes the shape of an inverted conical frustum the upper edge of which is positioned adjacent the inner edge of the flange 7 from the cylinder 3. The rotor 14 is provided with upper and lower radially extending lips **14*a*, 14*b* above and below said flange 7 respectively, so that a labyrinth seal is formed between the lips 14*a*, 14*b* and the flange 7**.

A shaft 18 for the rotor projects upwardly out of the container 2, 3 and is supported by radial and thrust bearings 19. The shaft 18 carries pulley wheels (not shown) so that the rotor 14 can be rotated by a vee-belt drive 20 from a suitable drive (not shown).

Figure 3:
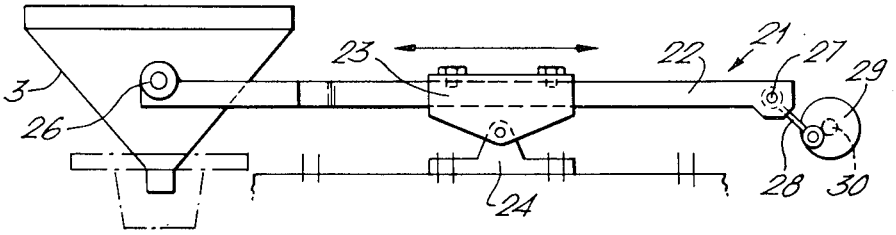
FIG. 3 shows a side elevational view of a drive for causing the vertical oscillation of the bottom casing portion of the jig of FIG. 1.
Figure 4:
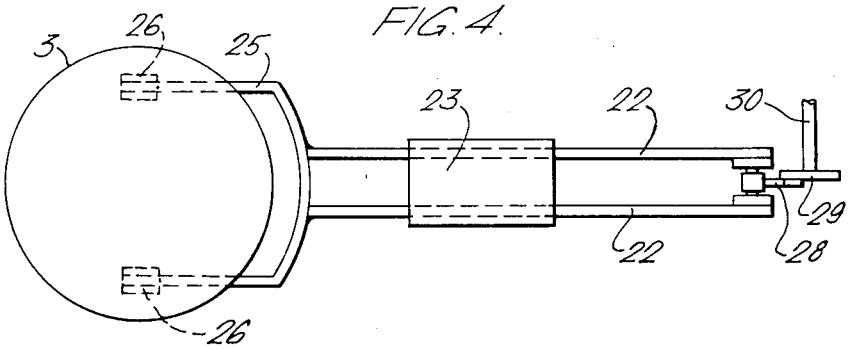
FIG. 4 is a plan view of the drive of FIG. 3.

Referring to FIGS. 3 and 4, a drive 21 is provided for oscillating the plunger 3 in a vertical direction (as shown by the arrows in FIG. 1) relative to the top portion 2. This drive 21 comprises a pair of parallel bar members 22 releasably secured intermediate their ends to a bracket 23 which is pivotally mounted about a horizontal axis on bearing block 24. One end of the bars 22 includes a bifurcation 25, and each end 26 of the bifurcation 25 diametrically engages the frustum 10 of plunger 3 through trunions; and at the other end of the bars 22 a shaft 27 extends transversely between the bars and carries a crank rod 28 which is eccentrically coupled to a wheel 29 rotated by suitable drive means (not shown) by means of shaft 30. The vertical stroke can be varied by adjustment of the bracket position on the bars 22 which requires the block 24 being unbolted from its foundation and repositioned.

Those components of the jig 1 which come in contact with slurry are preferably of abrasion resistant material or have a coating of abrasion resistant material.

In operation, a slurry containing mineral to be separated and lighter minerals is supplied to a bed of haematite arranged to a depth of about two inches on the screen 16 and contained by the basket means 17. The rotor 14 is rotated and the plunger 3 of the container oscillated, the container 2, 3 at this time being full of water supplied and made up through the water inlet 6.

Thus the slurry on the rotor 14 is subjected to pulsations as a result of the oscillation of the plunger 3 and to centrifugal force as a result of the rotation of the rotor 14 which causes a vortex to form in the container 2 coaxial therewith. The heavy mineral passes through the screen 16 and is concentrated in the bottom 3 of the container, being removed from the container through the moulded rubber outlet nozzle 11 which provides a somewhat constricted passage. The lighter minerals are caused to move up the rotor 14 and eventually spill over the edge thereof, these minerals or tailings being collected in the discharge trough 8.

Thus separation of the heavy mineral is achieved by a combination of elutriation, hindered settling, certain dynamic phenomena imparted by the pulsations and centrifugal force.

Figure 5:
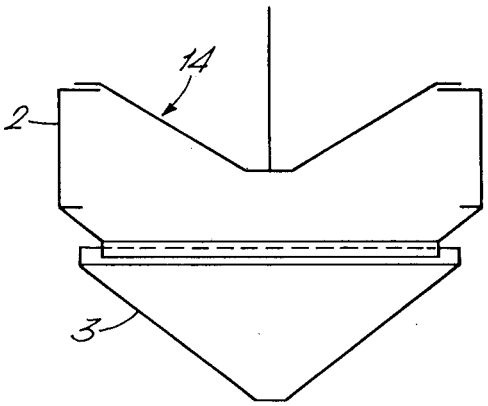
FIGS. 5 to 7 show modified forms of the jig casings.
Figure 6:
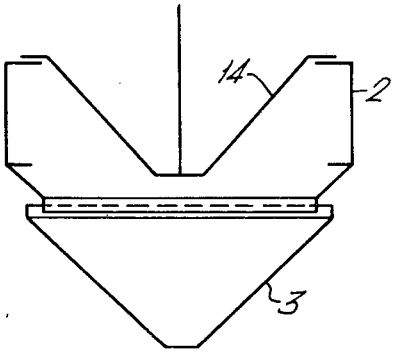
Figure 7:
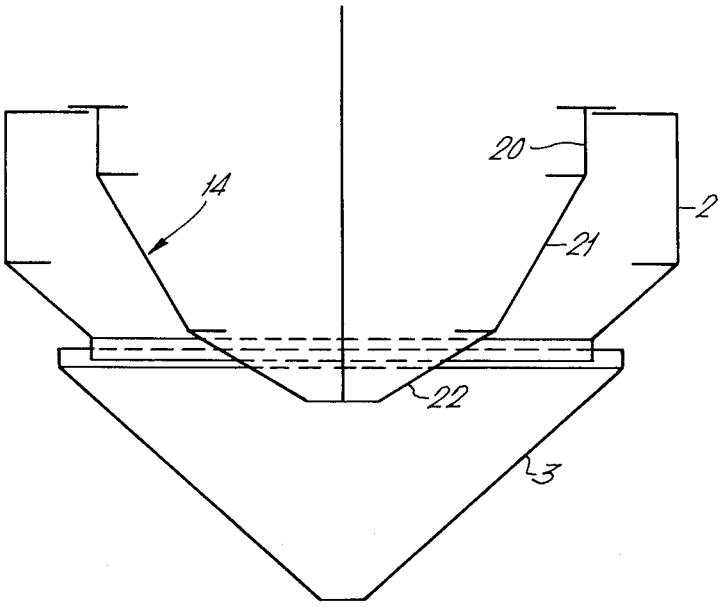

It will be realised that the rotor (and container) is shaped to conform as far as possible to the predicted form of the vortex, (compare FIGS. 5 and 6). The modified rotor shown in FIG. 7, which rotor is intended to operate at a relatively higher speed than that described above has a particularly deep dishing and comprises, from top to bottom, a cylindrical portion 20, a frusto-conical intermediate portion 21 and a frusto-conical lower portion 22 having less steep sides than the intermediate portion 21.

Figure 8:
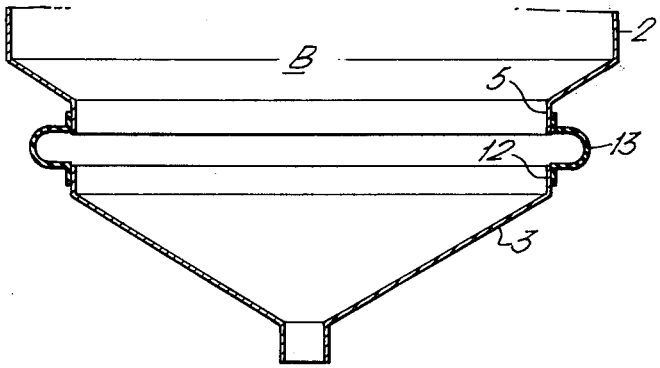
FIG. 8 shows a modification to the seal arrangement between the top and bottom casing portions of the jig of FIG. 1.

In the further modification shown in FIG. 8 the vertical flanges 5, 12 formed at the base of the top portion 2 and at the top of the plunger 3 have the same radius, the portions being sealingly connected by a rubber diaphragm 13 of a substantially C-shaped cross-section.

In this specification the liquid mixed with the minerals to form the slurry has been described as being water. It should be realised, however, that other liquids may be employed.

Further modifications are possible. For example, the rotor 14 could be driven by a directly coupled gear motor or by directly coupled hydraulic motor. Also, vertical oscillation of the jig plunger 3 could be achieved by a controlled hydrostatic system wherein the plunger is oscillated by a hydraulic cylinder (with or without the balanced beam) or alternatively by a totally enclosed oscillating gearbox similar to that used in a conventional Yuba jig.

I claim:

1. A mineral jig comprising a container for water, pulsating means to cause said water to pulsate in the container, an inlet to the container for water, a rotor mounted for rotation about a vertical axis and including a rotary frusto-conical bed in the container; said bed having a permeable frusto-conical wall; an inlet discharging into the bed for slurry; an outlet from the container for concentrated slurry; said rotor being connectible to a drive and the frusto-conical bed being arranged such that a slurry vortex is formed thereon on rotation of the bed whereby material separation is achieved by heavier materials of the slurry passing through the permeable frusto-conical wall of the bed while lighter materials move up the frusto-conical wall for discharge from an upper end of the bed; and receiving means at the upper end of the bed for lighter materials discharged from the bed.

2. The jig according to claim 1, wherein the container has a bottom portion of inverted substantially frusto-conical form.

3. The jig according to claim 2, wherein the container has a top portion including a cylindrical part.

4. The jig according to claim 3, wherein the top portion of the container has a lower part which tapers inwardly.

5. The jig according to claim 2, wherein said outlet from the container is provided at the bottom of said inverted frusto-conical portion.

6. The jig according to claim 2, wherein the outlet includes a replaceable outlet nozzle of a resilient abrasion resistant material fitted to the exterior of the bottom portion.

7. The jig according to claim 2, wherein the bottom portion is provided with means to cause oscillation thereof in a vertical direction to generate said pulsations in the water.

8. The jig according to claim 7, wherein a diaphragm of a resilient material is provided between said frusto-conical bottom portion of the container and a top portion of the container.

9. The jig according to claim 7, including means to alter the amplitude of the vertical oscillations.

10. The jig according to claim 1, wherein said bed comprises an open framework and screen means supported on said open framework.

11. The jig according to claim 10, wherein the screen means is any one of woven mesh wire and perforated sheet material.

12. The jig according to claim 1, wherein the container includes an annular portion at its upper end which is in interleaved relationship with an annular portion of the rotor for the formation of a labyrinth seal between the container and the rotor.

13. The jig according to claim 16, wherein said receiving means for the lighter materials comprises a volute shaped discharge trough.

14. A method of separating minerals from a slurry mixture of relatively heavy minerals and relatively light minerals in water comprising feeding the slurry mixture on to a frusto-conical upright permeable member which is arranged for rotation about a vertical axis and which has an upper discharge, further diluting the said mixture, imparting pulsations to said slurry and forming a slurry vortex on the frusto-conical member by rotation of the member about said vertical axis whereby mineral separation occurs by relatively heavy minerals passing through the permeable frusto-conical member while light minerals move up the member to the upper discharge of the member.

* * * * *